US008089426B2

(12) United States Patent
Ogawa et al.

(10) Patent No.: US 8,089,426 B2
(45) Date of Patent: Jan. 3, 2012

(54) PLASMA DISPLAY PANEL DRIVE METHOD OF DETERMINING A SUBFIELD, HAVING A LOW LUMINANCE, FOR PERFORMING AN EVERY-CELL INITIALIZATION OPERATION AND SETTING A WIDTH OF A SUSTAIN PULSE OF THE SUBFIELD FOR PERFORMING THE EVERY-CELL INITIALIZATION OPERATION

(75) Inventors: Kenji Ogawa, Osaka (JP); Tomohiro Murakoso, Hyogo (JP); Yoshiki Tsujita, Osaka (JP); Kenji Sasaki, Osaka (JP); Yohei Koshio, Osaka (JP)

(73) Assignee: Panasonic Corporation, Osaka (JP)

( * ) Notice: Subject to any disclaimer, the term of this patent is extended or adjusted under 35 U.S.C. 154(b) by 1084 days.

(21) Appl. No.: 11/628,434

(22) PCT Filed: Feb. 22, 2006

(86) PCT No.: PCT/JP2006/303116

§ 371 (c)(1),
(2), (4) Date: Dec. 5, 2006

(87) PCT Pub. No.: WO2006/090713

PCT Pub. Date: Aug. 31, 2006

(65) Prior Publication Data

US 2007/0241994 A1 Oct. 18, 2007

(30) Foreign Application Priority Data

Feb. 25, 2005 (JP) ..... 2005-050443

(51) Int. Cl.
*G09G 3/28* (2006.01)

(52) U.S. Cl. ..... 345/60

(58) Field of Classification Search ..... 345/60
See application file for complete search history.

(56) References Cited

U.S. PATENT DOCUMENTS 6,294,875 B1 9/2001 Kurata et al.
6,621,230 B2 * 9/2003 Lim et al. ..... 315/169.3
6,900,781 B1 5/2005 Mori et al.
7,173,850 B2 * 2/2007 Sakui et al. ..... 365/185.05
(Continued)

FOREIGN PATENT DOCUMENTS

CN 1271155 10/2000
(Continued)

*Primary Examiner* — Richard Hjerpe
*Assistant Examiner* — Andrew Schnirel
(74) *Attorney, Agent, or Firm* — Wenderoth, Lind & Ponack, L.L.P.

(57) ABSTRACT

A plurality of subfields of a field period includes a subfield for performing an every-cell initialization causing an initial discharge in every discharge cell in an initialization period, and includes a subfield for performing a selective initialization causing the initial discharge in a predetermined discharge cell in the initialization period. In a low-luminance subfield, the every-cell initialization is performed, and a low-luminance subfield is subsequently located (in the field period) to the subfield for the every-cell initialization. In a sustain period of the subfield for performing the every-cell initialization or a sustain period of the low-luminance subfield, a width of a first sustain pulse is set wider than a width of a second sustain pulse, and the width of the second sustain pulse is set wider than the width of a third sustain pulse and subsequent others.

10 Claims, 10 Drawing Sheets

U.S. PATENT DOCUMENTS

| | | | | |
|---|---|---|---|---|
| 2002/0054002 | A1 | 5/2002 | Tokunaga et al. | |
| 2004/0012547 | A1* | 1/2004 | Lee | 345/60 |
| 2004/0164933 | A1* | 8/2004 | Weitbruch et al. | 345/63 |
| 2004/0233131 | A1* | 11/2004 | Kang et al. | 345/60 |
| 2006/0227075 | A1* | 10/2006 | Kim | 345/63 |

FOREIGN PATENT DOCUMENTS

| | | | |
|---|---|---|---|
| EP | 1 047 041 | | 10/2000 |
| EP | 1657702 | * | 6/2005 |
| JP | 7-134565 | | 5/1995 |
| JP | 8-278766 | | 10/1996 |
| JP | 2000-242224 | | 9/2000 |
| JP | 2001-228820 | | 8/2001 |
| JP | 2001-337648 | | 12/2001 |
| JP | 2002-6806 | | 1/2002 |
| JP | 2002-207449 | | 7/2002 |
| KR | 2000-0053573 | | 8/2000 |
| KR | 10-2004-0023932 | | 3/2004 |
| KR | 1020040093723 | * | 11/2004 |

* cited by examiner

FIG. 10

| Device temperature | 0 degrees | 5 degrees | 10 degrees | 15 degrees | 20 degrees | 25 degrees or more |
|---|---|---|---|---|---|---|
| Width of first sustain pulse | 45μ Seconds | 40μ Seconds | 35μ Seconds | 30μ Seconds | 25μ Seconds | 20μ Seconds |
| Width of second sustain pulse | 6.5μ Seconds | 6.0μ Seconds | 5.5μ Seconds | 5.0μ Seconds | 4.5μ Seconds | 4.0μ Seconds |

PLASMA DISPLAY PANEL DRIVE METHOD OF DETERMINING A SUBFIELD, HAVING A LOW LUMINANCE, FOR PERFORMING AN EVERY-CELL INITIALIZATION OPERATION AND SETTING A WIDTH OF A SUSTAIN PULSE OF THE SUBFIELD FOR PERFORMING THE EVERY-CELL INITIALIZATION OPERATION

This application is a U.S. National Phase Application of PCT International Application PCT/JP2006/303116.

BACKGROUND OF THE INVENTION

1. Field of Invention

The present invention relates to a method of driving a plasma display panel for use as a low-profile and lightweight display device with a large screen.

2. Description of the Related Art

An alternating-plane discharge-type panel typified by a plasma display panel (hereinafter, simply referred to as "panel") is formed with a large number of discharge cells between a front plate and a rear plate, which are disposed opposing each other. The front plate is formed with, on a front glass substrate, a plurality of display electrodes configuring a plurality of pairs of scanning electrode and sustain electrode in a parallel manner, and to cover such display electrodes, a dielectric layer and a protection layer are formed. The rear plate is formed with a plurality of parallel data electrodes on a rear glass substrate, a dielectric layer to cover those, and a plurality of partition walls thereon in parallel to the data electrodes. A fluorescent layer is each formed to the surface of the dielectric layer and the side surfaces of the partition walls. In such a manner that the display electrodes spatially intersect with the data electrodes, the front plate and the rear plate are disposed opposing each other and sealed. The inner discharge space is filled with a discharge gas. Herein, a discharge cell is formed to any portion formed by the opposing display electrode and data electrode. With a panel configured as such, gas discharge in the respective discharge cells generates ultraviolet rays, and the ultraviolet rays excite the fluorescent layers of RGB colors for light emission so that the color display is made.

As a method of driving the panel, a subfield method is popular, i.e., a field period is divided into a plurality of subfields (hereinafter, simply referred to as "SFs"), and then the subfields are combined together for light emission so that the luminance display is made. The subfield method includes a driving method with which the contrast ratio is improved by suppressing the increase of black luminance through reduction, to a minimum, of light emission not affecting the luminance display.

Such a driving method is described below. FIG. 11 is an operation drive timing chart showing a conventional plasma display panel driving method. Each SF includes an initialization period, a writing period, and a sustain period. In the initialization period, an initialization operation of either an every-cell initialization operation or a selective initialization operation is performed. With the every-cell initialization operation, every discharge cell in charge of image display is made to perform initial discharge, and with the selective initialization operation, any discharge cell through with sustain discharge in the immediately-preceding SF is made to selectively perform initial discharge. With the drive waveform of FIG. 11, the every-cell initialization operation is performed in the initialization period of a 1SF, and in the initialization periods of a 2SF to the last SF, the selective initialization operation is performed.

First of all, in the initialization period of the 1SF, every discharge cell goes through initial discharge all at once, thereby deleting the previous histories of a wall charge on the respective discharge cells, and forming any needed wall charge for the subsequent writing operation. Not only that, there is a function of generating priming (initiating agent for discharge=exciting particles) for reducing a discharge delay, and causing writing discharge with stability. Every data electrode and every sustain electrode are maintained at 0 (ground potential), and every scanning electrode is applied with a lamp voltage that gently increases from a voltage Vp of a discharge start voltage or lower to a voltage Vr exceeding the discharge start voltage. This causes weak discharge in every discharge cell, stores a positive wall charge on the sustain electrodes and the data electrodes, and stores a negative wall charge on the scanning electrodes. Thereafter, every sustain electrode is maintained at a voltage Vh, and every scanning electrode is applied with a lamp voltage that gently decreases from a voltage Vg to a voltage Va. This causes weak discharge in every discharge cell, and weakens the wall charge stored on the electrodes. With such an every-cell initialization operation, the voltage in the discharge cells is put in the state closer to the discharge start voltage. Herein, the period in which the voltage increases from the voltage Vp to the voltage Vr is referred to as an ascending lamp period, and the period in which the voltage decreases from the voltage Vg to the voltage Va is referred to as a descending lamp period.

In the writing period of the 1SF, the scanning electrodes are sequentially applied with a scanning pulse, and the data electrodes are applied with a writing pulse corresponding to a video signal for display. Through such pulse application, writing discharge is caused selectively between the scanning electrodes and the data electrodes in any displaying discharge cell (display cell), and a wall charge is selectively formed. In the sustain period subsequent to the writing period, a sustain pulse is applied between the scanning electrodes and the sustain electrodes for a predetermined number of times, depending on the luminance weight, and in any discharge cell through with wall charge formation by the writing discharge, sustain discharge is selectively caused for light emission. With such light emission, the video is displayed.

In the initialization period of the 2SF, every sustain electrode is maintained at the voltage Vh, every data electrode is maintained at 0, and every scanning electrode is applied with a lamp voltage that gently decreases from a voltage Vb to the voltage Va. During when this lamp voltage decreases, weak discharge is caused in the discharge cell (s) through with the sustain discharge in the immediately-preceding sustain period (sustain period of the 1SF) so that the wall charge formed on the electrodes is weakened, and the voltage in the discharge cells is put in the state closer to the discharge start voltage. On the other hand, in the discharge cell(s) not through with the writing discharge and the sustain discharge in the 1SF, no weak discharge is caused in the initialization period of the 2SF, and the discharge cell(s) remain in the wall charge state after the initialization period is through in the 1SF.

As to the writing period and the sustain period of the 2SF, by waveform application similarly to the 1SF, sustain discharge is caused in any discharge cell corresponding to a video signal. As to the 3SF to the last SF, by drive waveform application to the electrodes similarly to the 2SF, the video display is made.

As such, for correct video display, it is important to perform selective writing discharge with reliability in a writing period, and for the purpose, it becomes important to perform, with reliability, an initialization operation to be ready for the writing discharge. Note here that the details of such a technology is disclosed in Japanese Patent Unexamined Publication NO. 2000-242224.

The issue here is that, in the initialization period of the 1SF of FIG. 11, the initial discharge must cause the scanning electrodes to each serve as an anode, and cause the sustain electrodes and the data electrodes to each serve as a cathode. However, because the data electrodes are each coated thereon with a fluorescent element whose secondary electron emission coefficient is low, the discharge delay is easily increased for the initial discharge with the data electrodes each serving as a cathode. What is more, recently, the study is under way to increase the light emission efficiency by increasing the partial pressure of xenon, which is a discharge gas filled in the panel. However, increasing the partial pressure of xenon, as such, results in a tendency of increasing the discharge delay of the initial discharge. Moreover, if the panel is used for a long length of time, the discharge delay is increased for the discharge cells. If the discharge delay is increased for the discharge cells as such, the initial discharge becomes unstable, and in the discharge cells with the longer discharge delay, the initial discharge that is supposed to be less intense in the ascending lamp period is sometimes increased in intensity. If this is the case, the initial discharge to be caused in the descending lamp period is also increased in intensity.

Also with the longer discharge delay, the writing discharge to be caused only to the display cells in a writing period is made unstable. The wall charge is thus not sufficiently formed, and there may be a case of failing in sustain discharge in the subsequent sustain period. With this being the case, the scanning electrodes are each stored thereon with a positive wall charge, and the sustain electrodes are each stored thereon with a negative wall charge. With the electrodes being in such states, the operation moves to the subsequent initialization period, and in the next initialization period for the every-cell initialization operation (initialization period of the 1SF), the resulting initial discharge caused in the ascending lamp period will be increased in intensity. As a result, the initial discharge to be caused in the descending lamp period is also increased in intensity.

As such, if the initial discharge is increased in intensity in the initialization period of the 1SF for the every-cell initialization operation, the scanning electrodes, as a result, store thereon too much positive wall charge by the time when the initialization period is through. In the discharge cells, even if no writing operation is executed in the subsequent writing period, the sustain discharge may be caused in the sustain period. That is, the discharge cells other than the display cells are illuminated, thereby resulting in erroneous discharge. Furthermore, because the intensity of such erroneous discharge is increased with a larger number of sustain pulses, the erroneous discharge is considerably conspicuous in the SFs with the larger luminance weight.

As such, the erroneous discharge occurring in the conventional drive method is very conspicuous, thereby greatly degrading the display quality.

BRIEF SUMMARY OF THE INVENTION

The present invention is proposed to solve such problems, and an object thereof is to provide a plasma display panel driving method that can achieve image display with good quality by suppressing the intensity of erroneous discharge.

In order to achieve the above object, the present invention is directed to a method of driving a plasma display panel in which: a field period is configured by a plurality of subfields each including an initialization period, a writing period, and a sustain period. These subfields include the subfield in charge of an every-cell initialization operation of causing initial discharge in every discharge cell in the initialization period, and the subfield in charge of a selective initial operation of causing the initial discharge in any predetermined discharge cell in the initialization period. The every-cell initialization operation is performed at least in one of the subfields of low luminance, and after the subfield performing the every-cell initialization operation, another of the subfields of low luminance is disposed. In at least either a sustain period of the subfield in charge of the every-cell initialization operation or a sustain period of the subfield of low luminance, the width of a first sustain pulse is set wider than the width of a second sustain pulse, and the width of the second sustain pulse is set wider than the width of a third sustain pulse and subsequent other sustain pulses.

According to the present invention, the intensity of the erroneous discharge can be suppressed to derive the good display quality. Moreover, by increasing the width of the first sustain pulse, the second sustain pulse used to have a difficulty in performing discharge can perform discharge with stability.

BRIEF DESCRIPTION OF THE DRAWINGS

FIG. 10 is a diagram showing an exemplary setting value of a device temperature and that of a sustain pulse width in the plasma display device.

DETAILED DESCRIPTION OF THE INVENTION

Below, a plasma display panel driving method is described in an embodiment of the present invention by referring to the accompanying drawings.

First Embodiment

Figure 1:
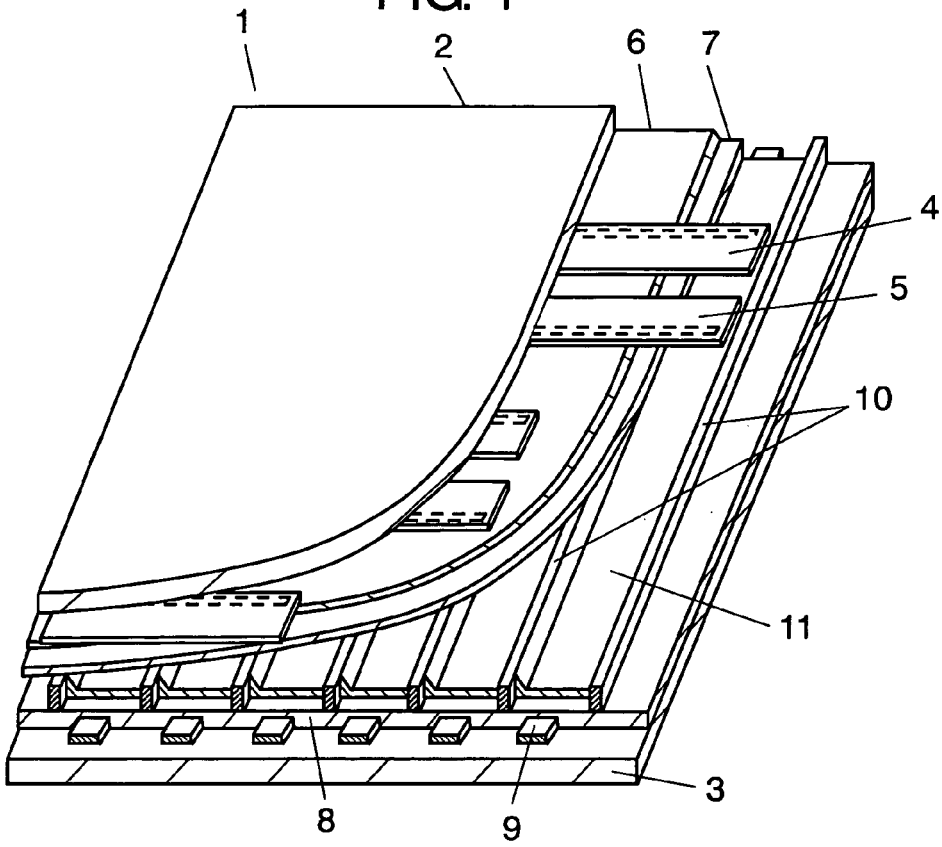
FIG. 1 is a partial perspective view of a plasma display panel as an embodiment of the present invention.

FIG. 1 is a perspective view of main portions of a panel for use in a first embodiment of the present invention. Panel 1 has such a configuration that glass-made front and rear substrates 2 and 3 are disposed opposing each other, and a discharge space is formed therebetween. Front substrate 2 is formed thereon with scanning electrode 4 and sustain electrode 5 configuring display electrodes, which are disposed in parallel for use as a pair, and such a pair is plurally formed. Dielectric layer 6 is formed to cover scanning electrodes 4 and sustain electrodes 5, and on dielectric layer 6, protection layer 7 is formed. In order to cause discharge with stability, protection layer 7 is preferably made of a material whose secondary electron emission coefficient is high and the sputtering resistance is high, and actually used is a thin film made of magnesium oxide (MgO). Rear substrate 3 is provided thereon with a plurality of data electrodes 9 covered by insulator layer 8, and on insulator layer 8 between data electrodes 9, partition walls 10 are each disposed in parallel to data electrodes 9. Fluorescent layer 11 is disposed on the surface of insulator layer 8 and the side surfaces of partition walls 10. In such a manner that scanning electrodes 4, sustain electrodes 5, and data electrodes 9 intersect with one another, front substrate 2 and rear substrate 3 are disposed opposing each other and sealed therearound. A discharge space formed therebetween is filled with a discharge gas, e.g., a mixture gas of neon (Ne) and xenon (Xe).

Figure 2:
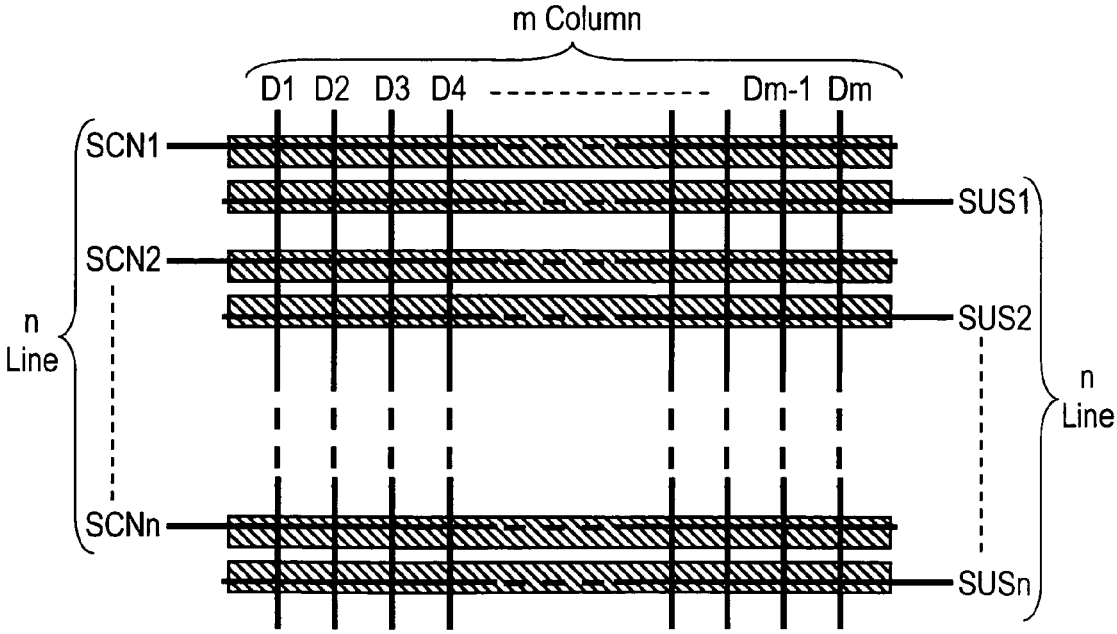
FIG. 2 is a diagram showing the electrode array of the plasma display panel.

FIG. 2 is a diagram showing the electrode array of the panel shown in FIG. 1. In the line direction, n pieces of scanning electrodes SCN1 to SCNn (scanning electrodes 4 of FIG. 1) and n pieces of sustain electrodes SUS1 to SUSn (sustain electrodes 5 of FIG. 1) are alternately arranged, and in the column direction, m pieces of data electrodes D1 to Dm (data electrodes 9 of FIG. 1) are arranged. The portions where a pair of the scanning electrode SCNi and the sustain electrode SUSi (i=1 to n) is intersected with any one data electrode Dj (j=1 to m) are each formed with a discharge cell, and m×n pieces of discharge cell are formed in the discharge space.

Figure 3:
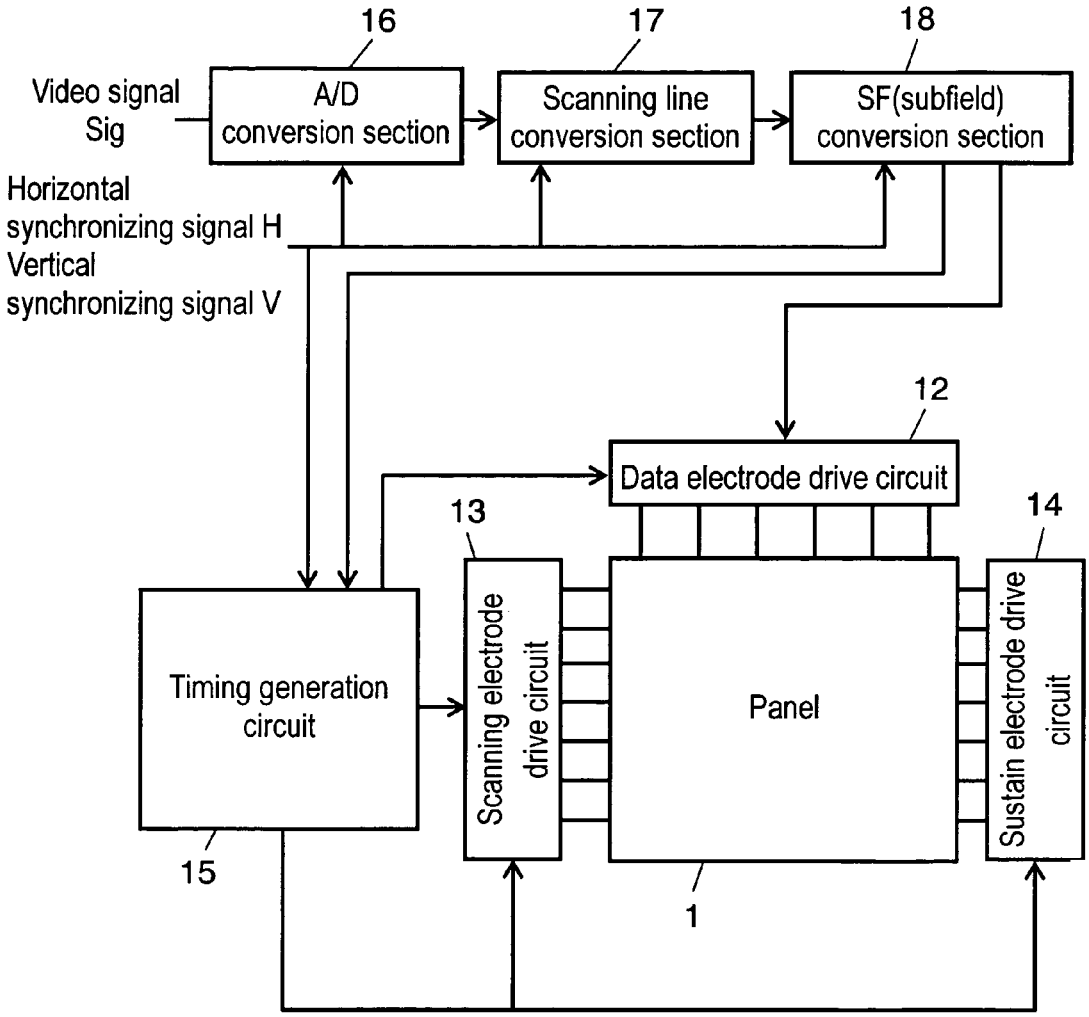
FIG. 3 is a diagram showing the configuration of a plasma display device as another embodiment of the present invention.

FIG. 3 is a diagram showing the configuration of a plasma display device configured by using the panel shown in FIGS. 1 and 2. This plasma display device is configured to include panel 1, data electrode drive circuit 12, scanning electrode drive circuit 13, sustain electrode drive circuit 14, timing generation circuit 15, A/D (analog/digital) conversion section 16, scanning line conversion section 17, SF (subfield) conversion section 18, and power supply circuit (not shown).

In FIG. 3, a video signal sig is provided to A/D conversion section 16. A horizontal synchronizing signal H and a vertical synchronizing signal V are forwarded to timing generation circuit 15, A/D conversion section 16, scanning line conversion section 17, and SF conversion section 18. A/D conversion section 16 converts the video signal sig into image data of a digital signal, and the resulting image data is output to scanning line conversion section 17. Scanning line conversion section 17 converts the image data into image data suiting the number of pixels of panel 1, and outputs the result to SF conversion section 18. SF conversion section 18 divides the image data, on a pixel basis, into a plurality of bits corresponding to a plurality of subfields, and outputs the image data of every subfield to data electrode drive circuit 12. Data electrode drive circuit 12 converts the image data, on a subfield basis, into a signal corresponding to each of the data electrodes D1 to Dm so that the data electrodes D1 to Dm are driven.

Timing generation circuit 15 generates a timing signal based on the horizontal synchronizing signal H and the vertical synchronizing signal V, and outputs the signal to both scanning electrode drive circuit 13 and sustain electrode drive circuit 14. Based on the timing signal, scanning electrode drive circuit 13 supplies a drive waveform to the scanning electrodes SCN1 to SCNn, and sustain electrode drive circuit 14 supplies a drive waveform to the sustain electrodes SUS1 to SUSn based on the timing signal.

Figure 4:
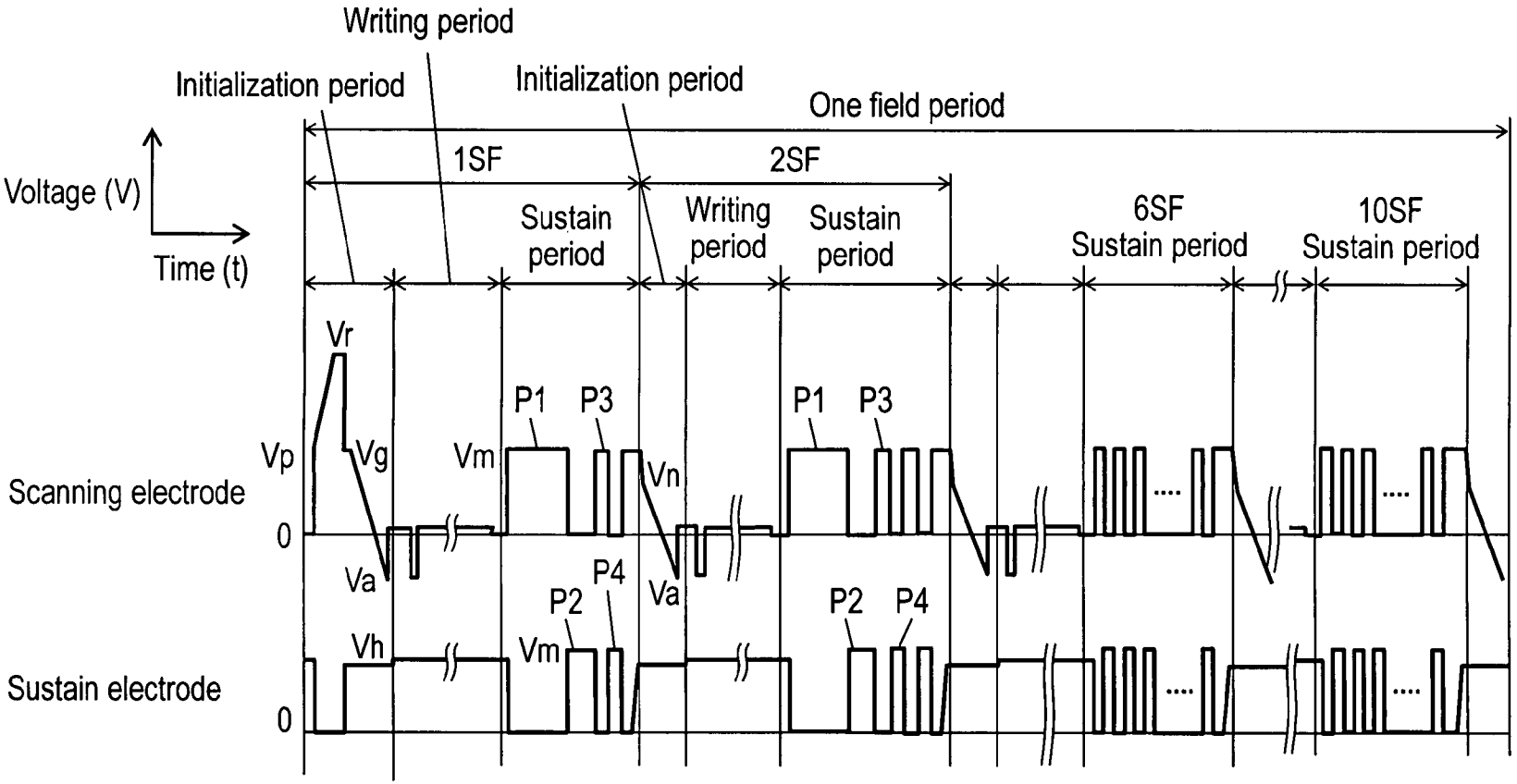
FIG. 4 is an operation drive timing chart showing a plasma display panel driving method as a first embodiment of the present invention.

Described next is the drive waveform to drive panel 1, and the operation thereof. FIG. 4 is a diagram showing a drive waveform for application to the scanning electrodes and the sustain electrodes of panel 1 in the first embodiment of the present invention. As shown in FIG. 4, a field period is divided into a plurality of (10 in this example) subfields (1SF, 2SF, . . . , 10SF), and the subfields of 1SF to 10SF have luminance weights of (1, 2, 3, 6, 11, 18, 30, 44, 60, and 80), respectively. As such, a field period is so configured that the subfields closer to the tail have the larger luminance weight. Note here that the number of subfields or the luminance weights of the subfields are not restrictive to the above values. Each of the subfields has an initialization period in which discharge cells are initialized in charge state, a writing period in which writing discharge is caused for selecting any discharge cell for display (display cells), and a sustain period in which sustain discharge is caused by the discharge cell (s) selected in the writing period. In the initialization period, an initialization operation of either an every-cell initialization operation or a selective initialization operation is performed. With the every-cell initialization operation, every discharge cell is made to perform initial discharge, and with the selective initialization operation, any discharge cell (any predetermined discharge cell) through with sustain discharge in the immediately-preceding SF is made to selectively perform initial discharge. With such initial discharge, the charge state of the discharge cells is initialized. With the drive waveform of FIG. 4, the every-cell initialization operation is performed in the initialization period of the 1SF, and in the initialization periods of the 2SF to 10SF, the selective initialization operation is performed.

First of all, in the initialization period of the 1SF, every discharge cell goes through initial discharge all at once, thereby deleting the previous histories of a wall charge on the respective discharge cells, and forming any needed wall charge for the subsequent writing discharge. Not only that, there is a function of generating priming for reducing a discharge delay, and causing writing discharge with stability. Every data electrode and every sustain electrode are maintained at 0 (ground potential), and every scanning electrode is applied with a lamp voltage that gently increases from the voltage Vp of a discharge start voltage or lower to the voltage Vr exceeding the discharge start voltage. This causes weak discharge in every discharge cell, stores a positive wall charge on the sustain electrodes and the data electrodes, and stores a negative wall charge on the scanning electrodes. Thereafter, every sustain electrode is maintained at the voltage Vh, and every scanning electrode is applied with a lamp voltage that gently decreases from Vg to Va. This causes weak discharge in every discharge cell, and weakens the wall charge stored on the electrodes. With such an every-cell initialization operation, the voltage in the discharge cells is put in the state closer to the discharge start voltage.

In the writing period of the 1SF, the scanning electrodes are sequentially applied with a scanning pulse, and the data electrodes are applied with a writing pulse corresponding to a video signal for display. Through such pulse application, writing discharge is caused selectively between the scanning electrodes and the data electrodes in any display cell, and a wall charge is selectively formed. In the sustain period subsequent to the writing period, a sustain pulse (voltage of which is Vm) is applied between the scanning electrodes and the sustain electrodes for a predetermined number of times depending on the luminance weight, and in any discharge cell through with wall charge formation by the writing discharge, sustain discharge is selectively caused for light emission. With such light emission, the video is displayed.

In the initialization period of the 2SF, every sustain electrode is maintained at the voltage Vh, every data electrode is maintained at 0, and every scanning electrode is applied with a lamp voltage that gently decreases from the voltage Vn to the voltage Va. During when this lamp voltage decreases, weak discharge is caused in the discharge cell (s) through with sustain discharge in the immediately-preceding sustain period (sustain period of the 1SF) so that the wall charge formed on the electrodes is weakened, and the voltage in the discharge cells is put in the state closer to the discharge start voltage. On the other hand, in any discharge cell not through with the writing discharge and the sustain discharge in the 1SF, no weak discharge is caused in the initialization period of the 2SF, and the discharge cell (s) remain in the wall charge state after the initialization period is through in the 1SF.

As to the writing period and the sustain period in the 2SF, by waveform application similarly to the 1SF, sustain discharge is caused in any discharge cell corresponding to a video signal. As to the 3SF to 10SF, by drive waveform application to the electrodes similarly to the 2SF, the video display is made. The sustain period is set as will be described later.

Figure 5:
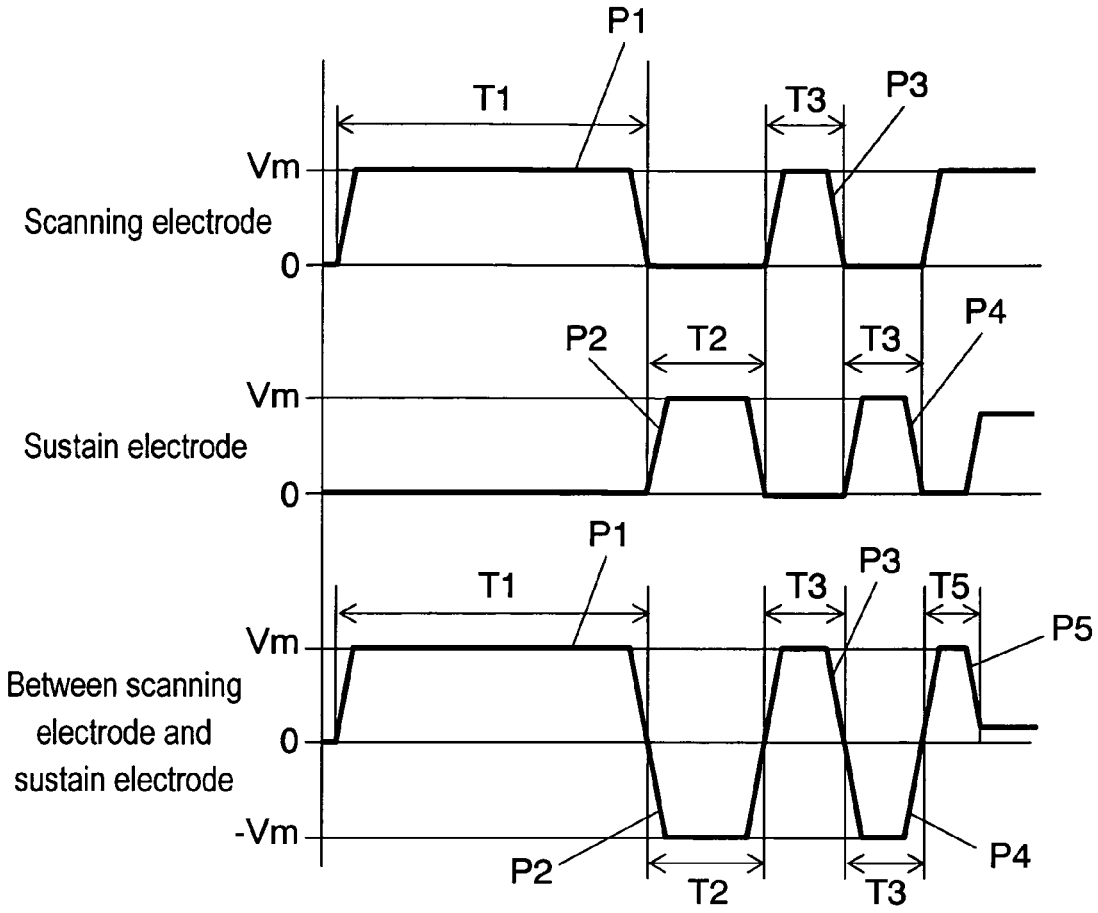
FIG. 5 is an enlargement view of a sustain period of a 1SF of FIG. 4.

FIG. 5 shows a drive waveform to be applied to the scanning electrodes and the sustain electrodes in the sustain period of the 1SF of FIG. 4, and FIG. 5 shows the resulting voltage to be applied between the scanning electrodes and the sustain electrodes relative to the sustain electrode. In the sustain period of the 1SF, first of all, the scanning electrodes are applied with a first sustain pulse P1, the sustain electrodes are then applied with a second sustain pulse P2, the scanning electrodes are then applied with a third sustain pulse P3, and the sustain electrodes are then applied with a fourth sustain pulse P4. Thereafter, the scanning electrodes and the sustain electrodes are applied with a voltage with each different timing. As a result, between the scanning electrodes and the sustain electrodes, pulse application is sequentially made, i.e., the first sustain pulse P1, the second sustain pulse P2, the third sustain pulse P3, the fourth sustain pulse P4, and a fifth sustain pulse P5. By these sustain pulses P1 to P5, the sustain discharge accordingly occurs. Assuming that the first sustain pulse P1 has a width (pulse width) of T1, the second sustain pulse P2 has a width of T2, and the third sustain pulse P3 has a width of T3, a setting is so made as to establish T1>T2>T3, and the fourth sustain pulse P4 has a width of T3. The fifth sustain pulse P5 has a width of T5, which is narrower than the width T3, and by this sustain pulse P5, the sustain discharge occurs lastly in this sustain period, and the sustain discharge is stopped.

Similarly to the 1SF, in the sustain period of the 2SF, assuming that the first sustain pulse P1 has a width of T1, the second sustain pulse P2 has a width of T2, and the third sustain pulse has a width of T3, a setting is so made as to establish T1>T2>T3, and the fourth sustain pulse and subsequent others has a width of T3. The last sustain pulse has a width narrower than the width T3. Although not shown, the 3SF and 4SF are set with the widths of sustain pulses similarly to the 1SF and 2SF. That is, in the 1SF to 4SF being the low-luminance subfields with smaller luminance weight, the width of the first sustain pulse is set wider than the width of the second sustain pulse, and the width of the second sustain pulse is set wider than the width of the third sustain pulse and subsequent others. In the 5SF to 10SF, the width of the sustain pulses is all set to T3 except the last sustain pulse, and the width of the last sustain pulse is set narrower than the width of T3. Note here that, although the widths T1, T2, and T3 of the sustain pulses are assumed as being the same in the 1SF to 4SF, these values may take each different value if the subfields are not the same, e.g., the value of T1 in the 1SF may be different from the value of T1 in the 2SF to 4SF.

Also in the sustain periods of 5SF to 10SF, the width of the first sustain pulse may be set wider than the width of the second sustain pulse, and the width of the second sustain pulse may be set wider than the width of the third sustain pulse and subsequent others. Also in this case, the width of the first sustain pulse in the 1SF to 4SF may be set to a value larger than the width of the first sustain pulse in the 5SF to 10SF, e.g., a value of twice or more. As such, the width of the first sustain pulse in the 1SF to 4SF may be set to be sufficiently large.

If the initial discharge is increased in intensity in the initialization period in the 1SF that is in charge of the every-cell initialization operation, the scanning electrodes may store thereon too much positive wall charge, and the non-display cells (discharge cells of making no display with no image data) may be put in the state that can cause sustain discharge. However, in the first embodiment, the first sustain pulse is increased in width in the 1SF so that the first sustain pulse can cause sustain discharge (erroneous discharge) in the non-display cells. Another possibility is that if the width of the first sustain pulse is sufficiently increased, sustain discharge may be delayed by the second sustain pulse to occur, thereby resulting in the insufficient sustain discharge and failing to sustain the sustain discharge. However, because the width of the second sustain pulse is set wider than the width of the third sustain pulse and subsequent others in this embodiment, the sustain discharge can be sustained with stability. This enables to appropriately adjust the wall charge in the initialization period thereafter (initialization period of 2SF) so that the erroneous discharge is prevented from occurring in the following sustain period (sustain period of 2SF).

As such, in the subfield (1SF) in charge of the every-cell initialization operation, the width of the first sustain pulse is set wider than the width of the second sustain pulse, and the width of the second sustain pulse is set wider than the width of the third sustain pulse and subsequent others. In this manner, even if the every-cell initialization operation increases the intensity of discharge, and even if the sustain discharge (erroneous discharge) occurs in the non-display cells, the subfields to be observed with the erroneous discharge can be limited to those with the intense discharge. This thus enables to prevent the erroneous discharge from occurring in the subsequent subfields with larger luminance weight so that the display quality can be controlled not to be reduced.

In the first embodiment, similarly to the 1SF, the widths of the sustain pulses are set in the 2SF to 4SF, which are subsequent to the subfield (1SF) in charge of the every-cell initialization operation. Accordingly, if such sustain discharge (erroneous discharge) in the non-display cells does not occur in the 1SF even if the scanning electrodes are stored thereon with too much positive wall charge as a result of the every-cell initialization operation (intense discharge) in the 1SF, the sustain discharge (erroneous discharge) can be caused in any one of the 2SF to 4SF. Because these 2SF to 4SF are small in luminance weight, the luminance as a result of erroneous discharge will be low even if such erroneous discharge occurs. Compared with a case where the erroneous discharge in the non-display cell occurs in any subfield with large luminance weight, the erroneous discharge is not that conspicuous, and the intensity of the erroneous discharge can be controlled to a level of not degrading the display quality.

In the first embodiment, in the 1SF to 4SF, the width of the first sustain pulse is set wider than the width of the second sustain pulse, and the width of the second sustain pulse is set wider than the width of the third sustain pulse and subsequent others. The subfields in which the sustain pulse is defined by width as such may be 1SF to 3SF or 1SF to 5SF, for example. Such a subfield selection may be made not to cause a problem in terms of display quality even if the erroneous discharge occurs. If a subfield (predetermined subfield) to be set with the sustain pulse width as the 1SF to 4SF in the above is plurally provided, the predetermined subfields may be disposed in a row in a field period, and any one of the predetermined subfields disposed at the head is assigned with the every-cell initialization operation. Herein, preferably, any predetermined number of subfields counted from the subfield with the smallest luminance weight is set as the predetermined subfields, and the number of the predetermined subfields may be a half or less of the entire subfields (10 in this first embodiment).

The predetermined subfields are not necessarily disposed in ascending order of luminance weight as in the first embodiment. However, the subfields causing the erroneous discharge in the non-display cells are preferably small in luminance weight. Therefore, the subfield in charge of the every-cell initialization operation is the subfield having the smallest luminance weight in the predetermined subfields, and the predetermined subfields are preferably disposed in ascending order of the luminance weight.

Exemplified here is a case of driving a 42-size plasma display panel of VGA type with Vp=Vg=170V, Vr=400V, Va=−80V, Vh=150V, Vm=170V, and Vn=100V, and as to the lamp voltage in the initialization period, the time taken to increase from Vp to Vr=60 μs, and the time taken to decrease from Vg to Va=250 μs. Moreover, in the sustain periods of the 1SF to 4SF, assumed here are that T1=25 μs, T2=4.5 μs, and T3=2.5 μs. In this exemplary case, the intense erroneous discharge is prevented from occurring, and the resulting display quality is good. In this example, as a result of studying the range of T1 and T2, with T1 of 10 μs or larger, and with T2 of 2 μs or larger but smaller than 10 μs, the resulting display quality is good. The upper limits of T1 can be lengthened as long as the drive time permits, and preferably 100 μs or smaller. The width of the first sustain pulse in the sustain periods of the 5SF to 10SF is smaller than T1, and may be about 6 μs.

For the aim of representing the luminance in detail specifically with a dark-luminance scene, there may a case of disposing a subfield having the smaller luminance weight than the 1SF preceding to the 1SF. Also in such a case, the widths of the sustain pulses may be set as in the present embodiment. In this case, the number of sustain pulses in the subfields having the smaller luminance weight than the 1SF is normally 1, and this subfield is not counted in the predetermined subfields.

As to the application of the lamp voltage in the initialization period, as an alternative to the lamp voltage, the voltage having a waveform of showing a gradual voltage value change will do. With such a voltage, the portion observed with the initial discharge may be applied with the waveform showing a change degree of about 0.1 V/μs to 10 V/μs.

Second Embodiment

Figure 6:
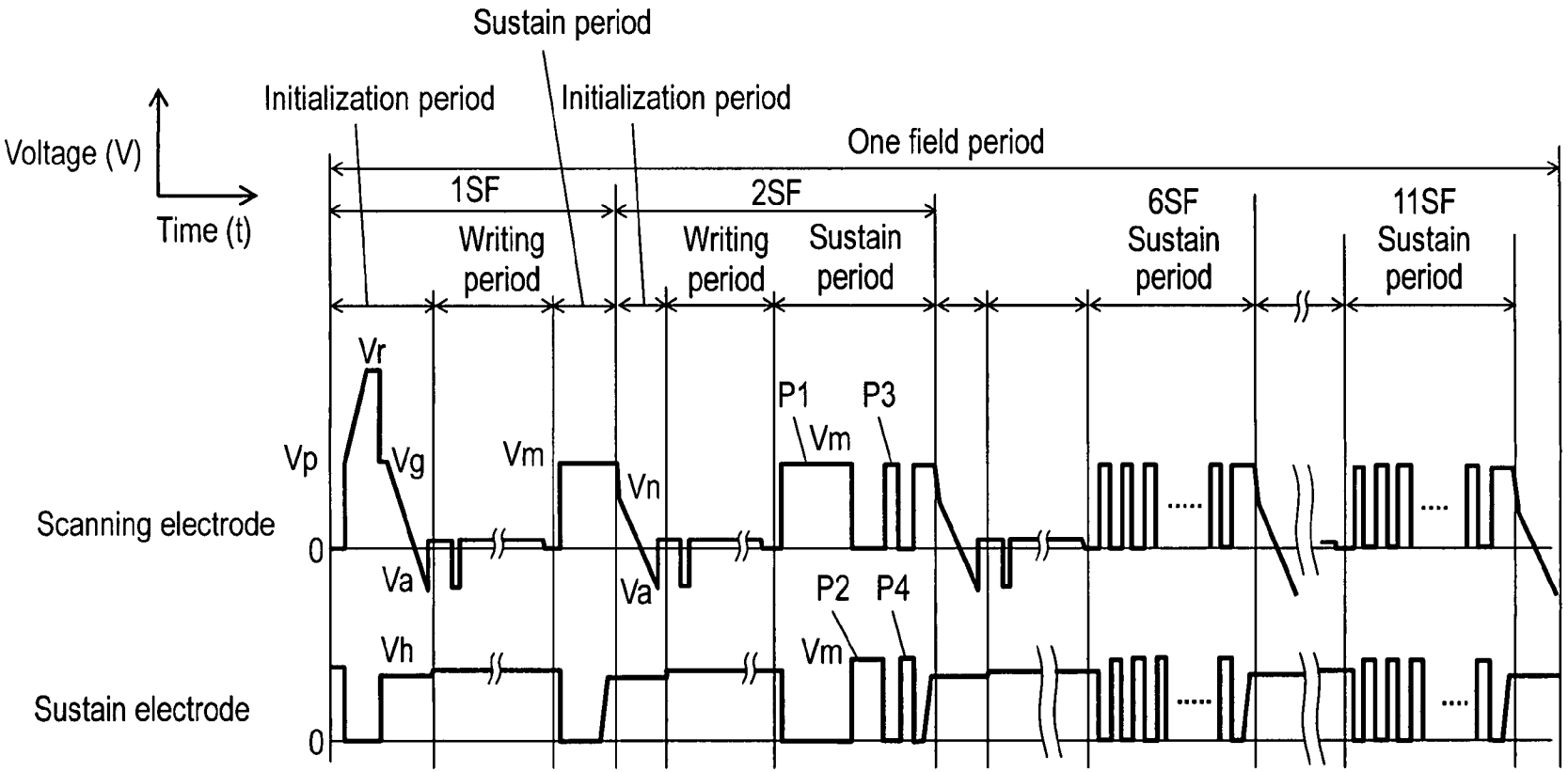
FIG. 6 is an operation drive timing chart showing a plasma display panel driving method as a second embodiment of the present invention.

Described next is a second embodiment of the present invention. FIG. 6 is a diagram showing a drive waveform for application to the scanning electrodes and the sustain electrodes of panel 1 in the second embodiment of the present invention. A field period of FIG. 6 is configured by 11 subfields, i.e., 10 subfields same as those in the drive waveform of FIG. 4 plus a subfield having the smaller luminance weight than the 1SF of FIG. 4. That is, the 2SF to 11SF of FIG. 6 are each have a luminance weight same as that of the 1SF to 10SF of FIG. 4, and the 1SF of FIG. 6 is the additional subfield. For example, the subfields of the 1SF to 11SF have the luminance weights of (0.5, 1, 2, 3, 6, 11, 18, 30, 44, 60, and 80), respectively. The subfields each include an initialization period, a writing period, and a sustain period, and the operation in the respective periods is similar to that of the first embodiment. The 3SF to 11SF of FIG. 6 have the same waveform as the 2SF to 10SF of FIG. 4, respectively, and the 2SF of FIG. 6 has the waveform similar to the 1SF of FIG. 4 except the initialization period.

As shown in FIG. 6, the every-cell initialization operation is executed in the 1SF, and the selective initialization operation is executed in the 2SF to 11SF. In the sustain period of the 1SF, the voltage is applied to the scanning electrodes and the sustain electrodes with each different timing so that a single sustain pulse is applied between the scanning electrodes and the sustain electrodes.

With such a configuration, even if the every-cell initialization operation in the 1SF causes the intense discharge and the sustain discharge (erroneous discharge) in the non-display cells, the subfields to be observed with the erroneous discharge are limited to the subfields of low luminance. That is, because the width of the first sustain pulse is made sufficiently wide in the 2SF to 5SF, the first sustain pulse can cause the sustain discharge (erroneous discharge) in the non-display cells. There may be a possibility that, with too wide a width of the first sustain pulse, the sustain discharge may be delayed by the second sustain pulse, thereby resulting in the insufficient sustain discharge and failing to sustain the sustain discharge. However, because the width of the second sustain pulse is set wider than the width of the third sustain pulse and subsequent others in this embodiment, the sustain discharge can be sustained with stability. This enables appropriate adjustment of the wall charge in the subsequent initialization period so that the sustain discharge is prevented from occurring in any subsequent sustain period. As a result, the erroneous discharge is prevented from occurring in the following subfields having the larger luminance weight so that the display quality can be prevented from being reduced.

In this example, in the 2SF to 5SF, the width of the first sustain pulse is set wider than the width of the second sustain pulse, and the width of the second sustain pulse is set wider than the width of the third sustain pulse and subsequent others. The subfields set with the widths of the sustain pulses as such may be the 2SF to 4SF or 2SF to 6SF, i.e., the subfields may be appropriately selected not to cause a problem in terms of display quality even if erroneous discharge occurs. As to the range of T1 and T2, the settings similar to the first embodiment will lead to the good display quality.

Third Embodiment

Figure 7:
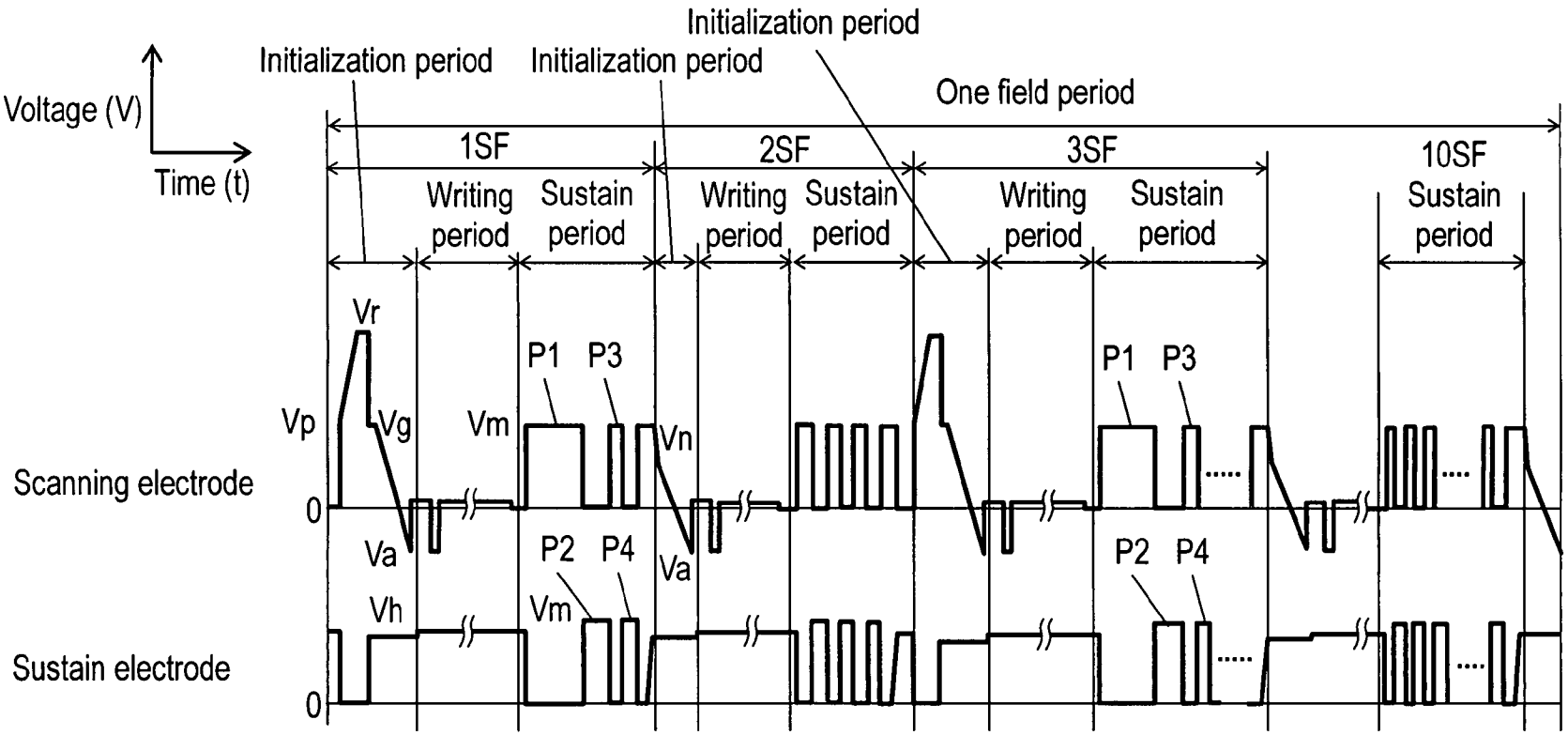
FIG. 7 is an operation drive timing chart showing a plasma display panel driving method as a third embodiment of the present invention.

Described next is a third embodiment of the present invention. FIG. 7 is a diagram showing a drive waveform for application to the scanning electrodes and the sustain electrodes of panel 1 in the third embodiment of the present invention. Similarly to the drive waveform of FIG. 4, a field period includes 10 subfields, and each of the subfields includes an initialization period, a writing period, and a sustain period. The operation in the respective periods is similar to that of the first embodiment.

In the third embodiment, as shown in FIG. 7, out of the subfields configuring a field period, a plurality of subfields are in charge of the every-cell initialization operation, and these subfields in charge of the every-cell initialization operation are those with low-luminance. That is, the every-cell initialization operation is performed in the initialization period of the 1SF and 3SF, and the selective initialization operation is performed in the initialization period of the 2SF and the 4SF to 10SF. In the 1SF and 3SF in charge of the every-cell initialization period, assuming that the first sustain pulse P1 has a width of T1, the second sustain pulse P2 has a width of T2, and the third sustain pulse P3 has a width of T3, a setting is made so as to establish T1>T2>T3. The fourth sustain pulse P4 and subsequent others have a width of T3, and the last sustain pulse is set so as to have a width narrower than the width T3. Note here that, in the 2SF and the 4SF to 10SF, the width of the sustain pulses is all set to T3 except the last sustain pulse, and the width of the last sustain pulse is set so as to be smaller than T3. Although the widths T1, T2, and T3 of the sustain pulses are assumed as being the same in the 1SF and 3SF, these values may take each different value if the subfields are not the same, e.g., the value of T1 in the 1SF may be different from the value of T1 in the 3SF.

With such a configuration, in the subfields (1SF and 3SF) in charge of the every-cell initialization operation, the width of the first sustain pulse is set wider than the width of the second sustain pulse, and the width of the second sustain pulse is set wider than the width of the third sustain pulse and subsequent others. In this manner, even if the every-cell initialization operation increases the intensity of discharge, and even if the sustain discharge (erroneous discharge) occurs in the non-display cells, the subfields to be observed with the erroneous discharge can be limited to those with the intense discharge. That is, with the sufficiently wide width of the first sustain pulse, the sustain discharge (erroneous discharge) can be caused in the first sustain pulse in the non-display cells. There may be a possibility that, with too wide width of the first sustain pulse, the sustain discharge may be delayed by the second sustain pulse to occur, thereby resulting in the insufficient sustain discharge and failing to sustain the sustain discharge. However, because the width of the second sustain pulse is set wider than the width of the third sustain pulse and subsequent others in this embodiment, the sustain discharge can be sustained with stability. This enables to appropriately adjust the wall charge in the initialization period thereafter so that the sustain discharge is prevented from occurring in any subsequent sustain period. As a result, the erroneous discharge is prevented from occurring in the following subfields with the larger luminance weight so that the display quality can be prevented from being reduced.

Alternatively, a low-luminance subfield may be disposed subsequent to the 1SF or 3SF, and in the low-luminance subfield, the width of the first sustain pulse may be set wider than the width of the second sustain pulse, and the width of the second sustain pulse may be set wider than the width of the third sustain pulse and subsequent others. With this being the case, the low-luminance subfield can cause the erroneous discharge even if the sustain discharge (erroneous discharge) in the non-display cells does not occur in the 1SF or 3SF. Because the low-luminance subfield has a small luminance weight, the luminance remains low even if such erroneous discharge occurs. Compared with a case where the erroneous discharge in the non-display cells occurs in any subfield with large luminance weight, the erroneous discharge is not that conspicuous, and the intensity of the erroneous discharge can be controlled to a level of not degrading the display quality.

Described in the third embodiment is the exemplary case of performing the every-cell initialization operation in the 1SF and 3SF. The present invention is surely not restrictive thereto, and can be applied to a case of performing the every-cell initialization operation in any other low-luminance subfields. As to the range of T1 and T2, settings similar to the first embodiment lead to the good display quality.

Fourth Embodiment

Figure 8:
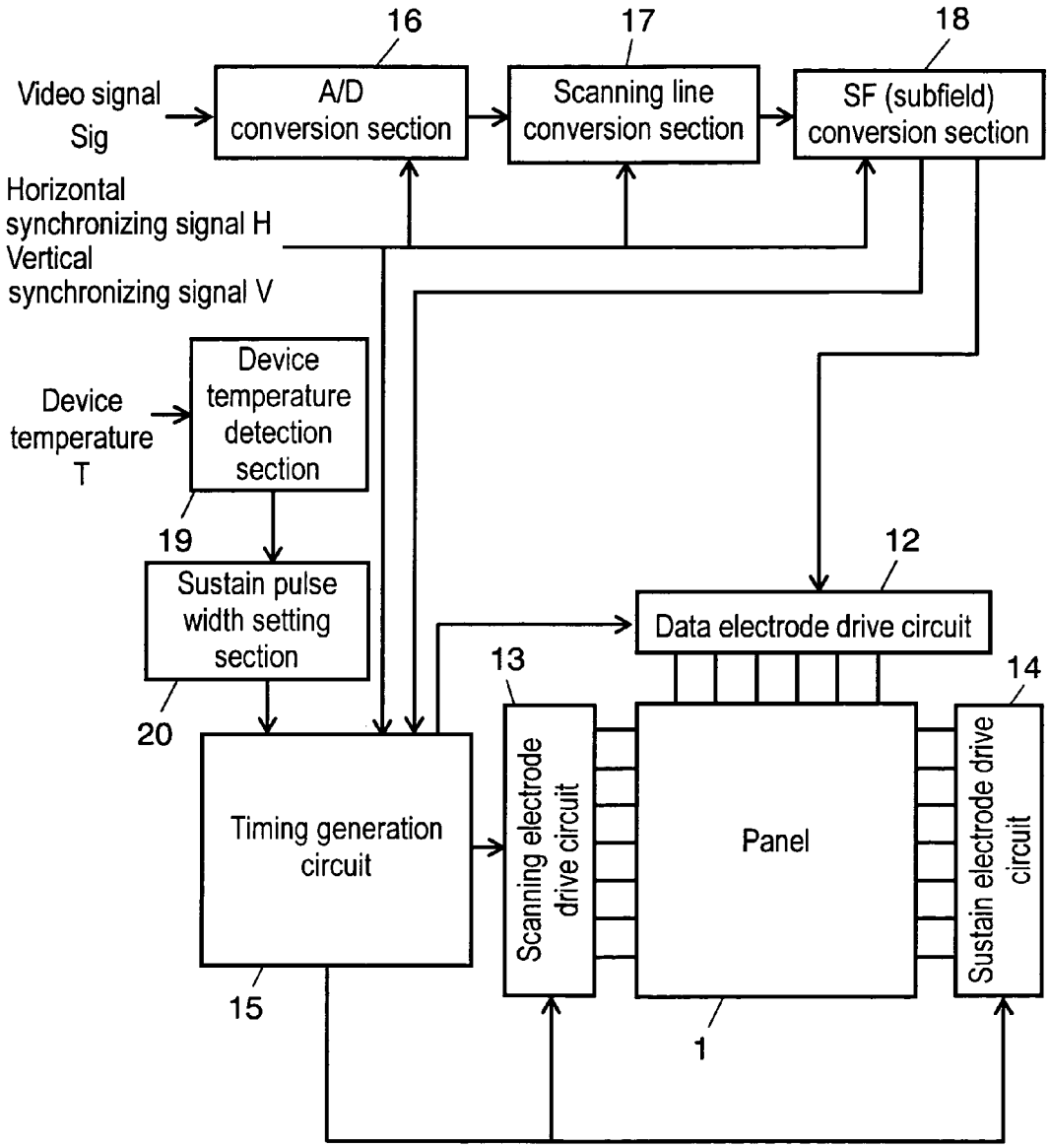
FIG. 8 is a diagram showing the configuration of a plasma display device as a fourth embodiment of the present invention.

Described next is a fourth embodiment of the present invention. FIG. 8 is a diagram showing the configuration of a plasma display device in the fourth embodiment. This plasma display device is configured to include panel 1, data electrode drive circuit 12, scanning electrode drive circuit 13, sustain electrode drive circuit 14, timing generation circuit 15, A/D conversion section 16, scanning line conversion section 17, SF conversion section 18, power supply circuit (not shown), device temperature detection section 19, and sustain pulse width setting section 20. With such a plasma display device, provisions of device temperature detection section 19 and sustain pulse width setting section 20 enable to determine and control, based on any change observed to the device temperature, the widths of the first and second sustain pulses in the sustain periods of the respective subfields configuring a field.

Figure 9:
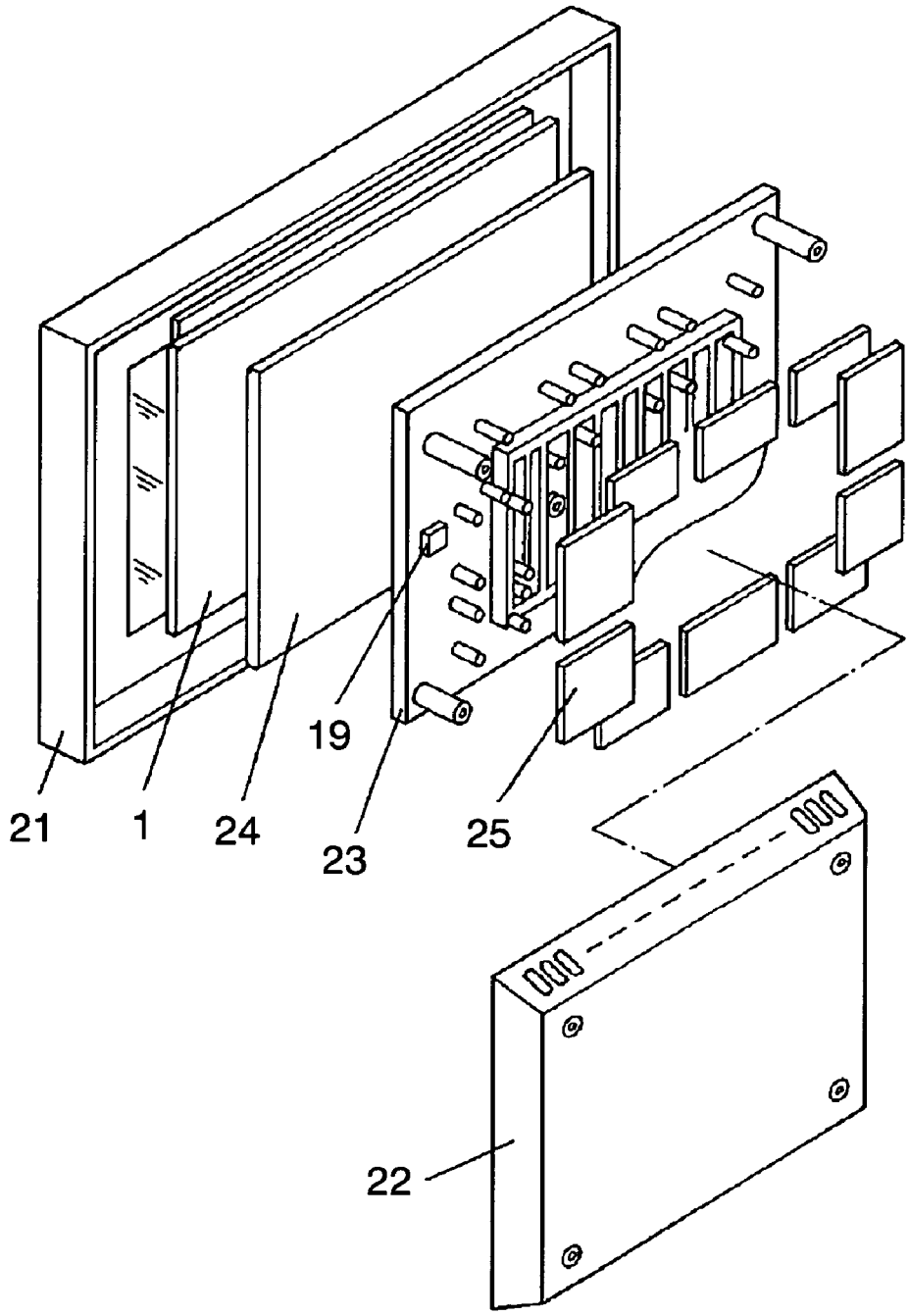
FIG. 9 is an exploded perspective view of an exemplary configuration of the plasma display device.
Figure 11:
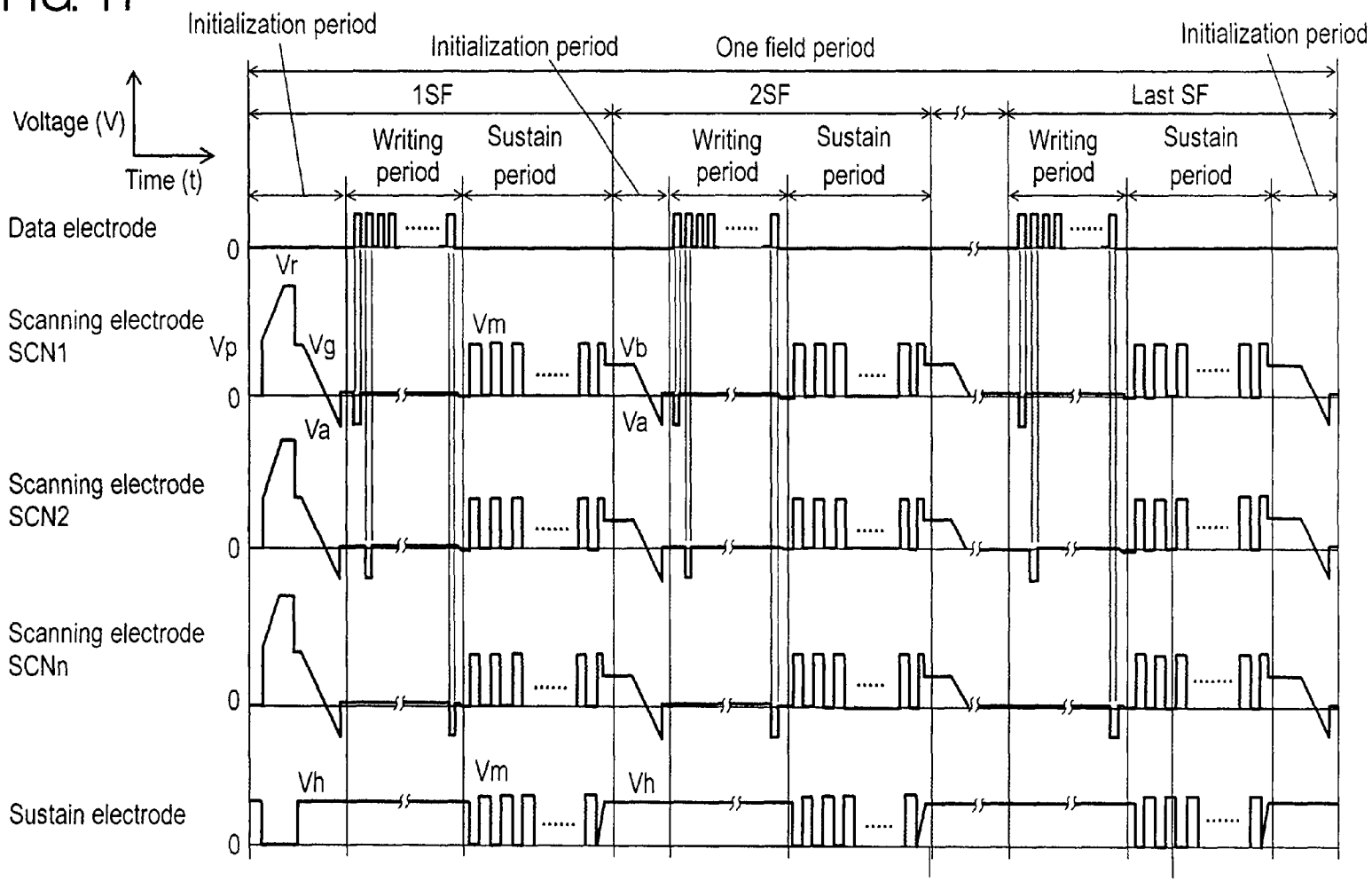
PRIOR ART FIG. 11
FIG. 11 is an operation drive timing chart showing a conventional plasma display panel driving method.

FIG. 9 is an exploded perspective view of an exemplary configuration of a plasma display device. The plasma display device is configured by including panel 1, electric circuit to drive panel 1 or others in a cabinet formed by front cover 21 and rear cover 22. Panel 1 is attached to the front surface side of chassis 23 via thermal conductive sheet 24, and the rear surface side of chassis 23 is attached with circuit substrate 25 including an electric circuit for driving and controlling panel 1. Chassis 23 is made of metal such as aluminum, and on the rear surface side of chassis 23, device temperature detection section 19 is disposed to detect temperature of chassis 23 as the device temperature.

The operation of the components except device temperature detection section 19 and sustain pulse width setting section 20 is similar to those in the first embodiment, and thus is not described again. As shown in FIG. 8, a device temperature T is detected by device temperature detection section 19, and is then forwarded to sustain pulse width setting section 20. Based on the device temperature T, sustain pulse width setting section 20 determines the widths of the first and second sustain pulses in the sustain period of the respective subfields, and timing generation circuit 15 generates a timing signal corresponding to the device temperature T.

FIG. 10 shows an exemplary relationship between the device temperature T and the widths of the first and second sustain pulses in the sustain periods of the 1SF to 4SF. As shown in FIG. 10, the width of the sustain pulse is so set as be wider as the device temperature T is decreased. This is because the increase of a discharge delay that causes the above-described erroneous discharge becomes apparent as the temperature is decreased. Through such control, the plasma display device can be driven in accordance with the usage environment thereof so that the good display quality can be derived in the low-temperature usage environment.

Even if the ambient temperature is low, the plasma display device is increased in device temperature if it is kept illuminated due to the temperature increase caused by its discharge cells' discharge or the temperature increase of the electric circuit in the illumination state. Accordingly, the discharge delay being apparent with the low-temperature is reduced as the device temperature is increased, and there may be a case of not causing erroneous discharge. As the plasma display panel is increased in definition, the drive time tends to have less margin, and this arises a need to shorten the width of the sustain pulse as much as possible, and to reserve the drive time. In consideration thereof, in the fourth embodiment of the present invention, when the device temperature T is increased, the width of the head sustain pulse in the sustain period of the respective subfields is shortened, and this eliminates the waste of the driving time and enables to reserve the drive time.

Note that, in this embodiment, FIG. 10 shows only an exemplary setting of the device temperature and the width of the sustain pulse, and the present invention is surely not restrictive thereto. With the drive method of the second or third embodiment, the method of the fourth embodiment is surely applicable.

As is evident from the above description, according to the present invention, the erroneous discharge can be controlled in intensity, and it is considered effective to derive a plasma display panel that performs image display with good quality.

The invention claimed is:

1. A method of driving a plasma display panel including a plurality of discharge cells for image display, wherein a field period includes a plurality of subfields, each subfield of the plurality of subfields including an initialization period, a writing period, and a sustain period, wherein the plurality of subfields of the field period includes (i) a subfield for performing an every-cell initialization operation, the every-cell initialization operation causing, in the initialization period of the subfield for performing the every-cell operation, an initial discharge in each of the plurality of discharge cells, and (ii) a subfield for performing a selective initialization operation, the selective initialization operation causing, in the initialization period of the subfield for performing the selective initialization operation, the initial discharge in any predetermined discharge cell of the plurality of discharge cells, wherein the method of driving the plasma display panel includes:

performing the every-cell initialization operation in a subfield, of the plurality of subfields, of a low luminance in comparison with other subfields of the plurality of subfields, such that the field period includes, subsequent to the subfield in which the every-cell initialization operation is performed, another subfield of the low luminance;

determining a subfield group, which includes at least one subfield of the plurality of subfields that is (i) for performing the every-cell initialization operation, and (ii) of the low luminance;

in a sustain period of each subfield of the at least one subfield of the subfield group, setting a width of a first sustain pulse to be wider than a width of a second sustain pulse, and setting the width of the second sustain pulse to be wider than a width of a third sustain pulse and subsequent other sustain pulses; and setting a width of each first sustain pulse of each of the plurality of subfields that is subsequent to the subfield group to a same predetermined value, such that the predetermined value represents a width that is smaller than the width of the first sustain pulse of each subfield of the at least one subfield of the subfield group, and wherein, in the every-cell initialization operation, the initial discharge is performed using a ramp voltage or a wave form having a change degree of 0.1 V/μs to 10 V/μs.

2. The plasma display panel driving method of claim 1, further comprising, in the sustain period of the subfield for performing the every-cell initialization operation, setting the width of the first sustain pulse to be wider than the width of the second sustain pulse, and setting the width of the second sustain pulse to be wider than the width of the third sustain pulse and subsequent other sustain pulses.

3. The plasma display panel driving method of claim 2, wherein, the field period includes, subsequent to the subfield for performing the every-cell initialization operation, a plurality of subfields of the low luminance, and wherein the plasma display panel driving method includes, in the sustain period of one of the plurality of subfields of the low luminance, setting the width of the first sustain pulse to be wider than the width of the second sustain pulse, and setting the width of the second sustain pulse to be wider than the width of the third sustain pulse and subsequent other sustain pulses.

4. The plasma display panel driving method of claim 1, wherein the width of the first sustain pulse is 10 μs or wider, and the width of the second sustain pulse is at least 2 μs and narrower than 10 μs.

5. The plasma display panel driving method of claim 2, wherein the width of the first sustain pulse is 10 μs or wider, and the width of the second sustain pulse is at least 2 μs and narrower than 10 μs.

6. The plasma display panel driving method of claim 3, wherein the width of the first sustain pulse is 10 μs or wider, and the width of the second sustain pulse is a least 2 μs and narrower than 10 μs.

7. The plasma display panel driving method of claim 1, wherein a device temperature is detected for a plasma display device that is configured by housing the plasma display panel in a cabinet, and based on the device temperature, the width of the first sustain pulse and the width of the second sustain pulse are changed.

8. The plasma display panel driving method of claim 2, wherein a device temperature is detected for a plasma display device that is configured by housing the plasma display panel in a cabinet, and based on the device temperature, the width of the first sustain pulse and the width of the second sustain pulse are changed.

9. The plasma display panel driving method of claim 3, wherein a device temperature is detected for a plasma display device that is configured by housing the plasma display panel in a cabinet, and based on the device temperature, the width of the first sustain pulse and the width of the second sustain pulse are changed.

10. The plasma display panel driving method of claim 1, wherein a number of subfields are included in the subfield group determined by the determining, such that the number of subfields is half or less of a number of subfields of the plurality of subfields in the field period.

* * * * *